United States Patent [19]

Miller et al.

[11] 4,215,597

[45] Aug. 5, 1980

[54] CLOSING DEVICE

[75] Inventors: John A. Miller, Midland, Mich.; Phillip L. Brookshire; William J. O'Neil, Jr., both of Cincinnati, Ohio

[73] Assignee: The Dow Chemical Company, Midland, Mich.

[21] Appl. No.: 942,101

[22] Filed: Sep. 13, 1978

[51] Int. Cl.[2] ..... B25B 27/02

[52] U.S. Cl. ..... 81/9.1 R; 29/238

[58] Field of Search ..... 81/3 R, 9.1 R, 43, 121 R; 29/235, 238

[56] References Cited

U.S. PATENT DOCUMENTS

| | | | |
|---|---|---|---|
| 2,579,207 | 12/1951 | Scheib | 81/3 R |
| 2,831,379 | 4/1958 | DeFore | 81/3 R |
| 4,009,899 | 3/1977 | Johnson | 81/43 X |
| 4,100,824 | 7/1978 | Marschke | 81/121 R |

*Primary Examiner*—James G. Smith

*Attorney, Agent, or Firm*—Lloyd E. Hessenaur, Jr.

[57] ABSTRACT

A device for closing zippers on plastic bags, the device being separable from the bags to enable repeated usage. The closing device is adapted to function as an extension of the finger-thumb action. It comprises a generally inverted U-shaped channel for receiving the interlocking elements of the zipper with the opposing legs of the device being resilient and engageable toward one another to press the interlocking zipper elements together. A guide is formed in the legs to align the zipper elements. Projections opposite the guide aid in giving a sense to the user of aligning of the guide with the zipper elements.

9 Claims, 10 Drawing Figures

CLOSING DEVICE

BACKGROUND OF THE INVENTION

Plastic bags containing an integral zipper or fastener with opposing male and female elements, such as illustrated by U.S. Pat. No. Re. 28,969, have been on the market place for a number of years. While bags with the integral zipper have many advantageous features, one of their difficulties has been in aligning and pressing together the zipper elements for closing of the bags by the average consumer. For this reason, attempts have been made to add closing devices or tools to the bags to permit ready closing of the zipper. Illustrations of such devices are shown in U.S. Pat. Nos. 3,122,807; 3,360,875; 3,790,992 and 3,806,998, for example. However these devices have not been particularly economical, not normally reusable, nor very successful in the market place. The need for an economical, reusable closing device which merely acts as a simple extension of the thumb and finger remained until the present invention was achieved.

SUMMARY OF THE INVENTION

The present invention comprises a device or tool for aligning and closing integral fastening or zipper elements for plastic bags. The closing device is separable from the bag so that it can be used many times to totally and simply close the zipper elements. The device includes an inverted U-shaped channel with flexible opposing legs having a means for guiding the legs onto the zipper elements and aligning these elements, aided by additional means whereby the sensitivity of the fingers and thumb to the proper location of the zipper elements within the closing device is included to permit ready and accurate closing of the bag. The guide means can include an embossed pressure means for further accentuating the closing function.

DETAILED DESCRIPTION OF THE PREFERRED EMBODIMENTS

Figure 4:
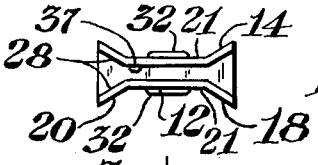
FIG. 4 is a bottom view thereof.
Figure 3:
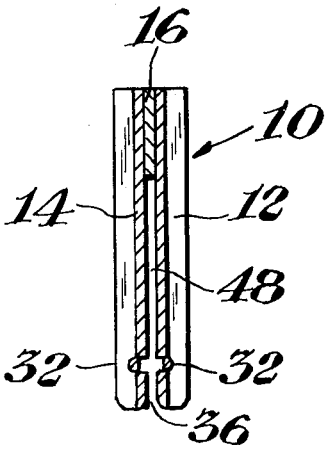
FIG. 3 is a cross-sectional view of the closing device of FIG. 1 taken along with the line 3—3 thereof.
Figure 1:
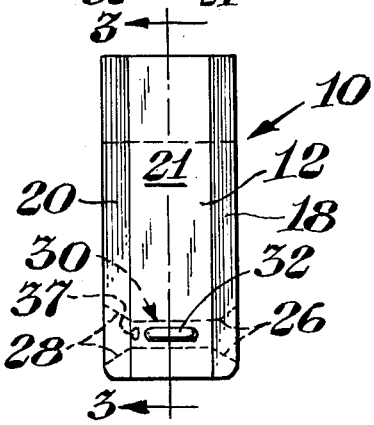
FIG. 1 is a front elevational view of a closing device constructed according to the principles of the present invention, the rear elevational view being the same.
Figure 2:
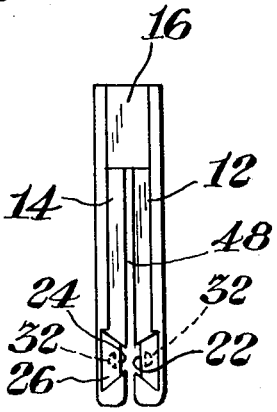
FIG. 2 is a side elevational view of the closing device of FIG. 1, the other side elevational view being the same.
Figure 10:
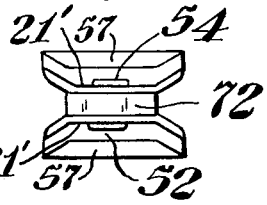
FIG. 10 is a bottom view of the closing device of FIG. 7.

In the exemplary embodiment of the invention disclosed in FIGS. 1 to 4 of the drawing, a closing device 10 includes a pair of resilient legs 12 and 14 in a generally inverted U-shaped disposition presenting a gap or channel 36 between the leg ends. The legs are joined at a bite or yoke portion 16 so that the entire device, legs and yoke portion, presents a generally inverted Y-shaped configuration. The legs of the closing device can be formed of a relatively resilient but tough, semi-rigid synthetic resin such as cellulose acetate butyrate, polypropylene, polyethylene, nylon, polycarbonate, impact polystyrene and various copolymers and blends thereof, and the like, suitable forms of which resins are well known in the trade.

The structure of the closing device is one which allows the use of finger or equivalent pressure to flex and close the legs 12 and 14 against one another yet retains sufficient resilience to open again with release of the finger pressure. The legs 12 and 14 can be rigidly attached to bite section 16 through solvent welding, sonic or other thermal welding, by the use of adhesives or can be mechanically fastened together. The closing device 10 can also be integrally formed of one piece by injection molding, if desired. The bite portion can be made of the same materials as the legs or can be of a different, perhaps more rigid material, such as an acrylic resin. In one actual sample of the invention the legs were formed of cellulose acetate butyrate and the bite portion was formed of an acrylic resin. However, it would function properly if it were instead formed entirely by injection molding of polypropylene resin material. In the sample, the legs were about $1'' \times \frac{1}{2}''$ having a material thickness of about 1/32". The gap 36 between the legs was about 1/16". The device readily closed a Ziploc® storage bag manufactured by The Dow Chemical Company.

The edges 18 and 20 of the legs 12 and 14 are preferably flared outwardly along the length of the legs as shown most clearly in FIG. 4. The flared edges present a channel 21 which acts as a guide for finger alignment on the device as described more particularly hereinafter. The corners and edges of the device 10 are preferably rounded or tapered to avoid catching of the bag thereon.

The lower ends of legs 18 and 20 have formed in their interior surfaces guides or grooves 22 and 24 adapted to receive the mating profiles of the bag zipper elements or fasteners. Preferably, the guides 22 and 24 are chamfered at sections 26 and 28 to funnel the mating zipper elements more readily into main central sections 30 of the guides 22 and 24 when the zipper elements are being secured together. Provided in the main sections 30 of the guides are finger sensing ridges 32 extending from channel surfaces 21 on each of the legs 12 and 14, respectively, to help locate the proper finger position for applying pressure directly against the mating profiles located within the guides 22 and 24. A raised pressure bump 37 can also be included on the inside of a section 30 to add to the closing pressure.

Figure 5:
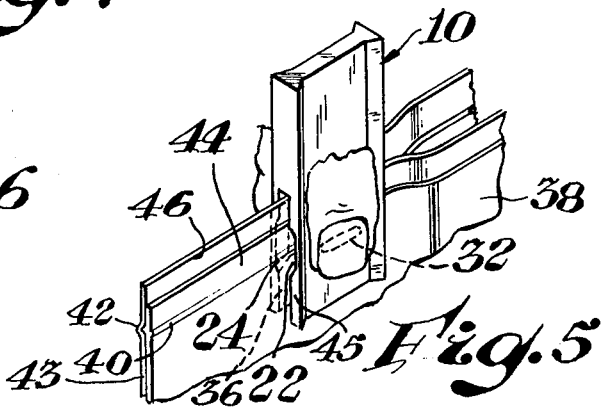
FIG. 5 is a fragmentary isometric view schematically showing how the closing device can align and close the integral zipper elements of a bag.

FIG. 5 represents the operation of closing zipper or fastening elements 40 and 42 of a bag 38 by use of the closing device 10. Bag 38 includes bag lips 44 and 46 which normally are used for pulling the bag zipper elements apart once the fastening elements 40 and 42 are secured together. Slot 48 of the closing device 10 has enough height so that it can take the extent of the lips 44 and 46 above the fastening members 40 and 42 which fit within the guides 22 and 24 of the closing device 10. Gap or slot 36 between the legs 12 and 14 is sufficient to take the width of the bag body although the gap can be more or less than that width.

In operation, left end 43 of the bag shown in FIG. 5 can be fed into the gap 36 at the left end 45 of closing device 10 with the zipper elements 40 and 42 entering the funnel-shaped zipper receiving section 28 (FIG. 1) of closing device 10 so that the zipper elements 40 and 42 are aligned within the section 30. This closing could alternately be done from the right end of the bag and either end of the closing device can be used as the device is the same on both sides and ends, except for the optional pressure bump 37.

Figure 6:
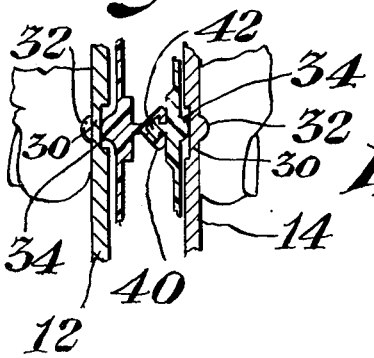
FIG. 6 is an enlarged fragmentary sectional view of the closing device of FIG. 5 showing the zipper elements pressed together.

Should the gap 36 be wide enough or resilient enough, then it is possible for the closing device to be inserted directly downwardly over the lips 44 and 46 and zipper elements 40 and 42 for accomplishing the closing operation rather than sliding the device over the same from the left end of the bag. However, the purpose of the funnel-shaped sections 26 and 28 is to facilitate feeding or entry of the zipper elements from the end of the closing device to accomplish the closing function in one preferred manner. Once the closing device is properly located over zipper elements 40 and 42, the user simply needs to locate his thumb and opposite index finger over the sensing ridges 32 which are exactly opposite fastening elements 40 and 42 and press the legs 12 and 14 together which causes mating of the zipper elements 40 and 42 together, and then slide closing device 10 along the open part of the zipper to close the zipper elements progressively from one end to the other, as illustrated in FIG. 5 from the left end to the right end of the bag. This results in a complete closing of the zipper elements 40 and 42 to secure any contents therein. FIG. 6 illustrates in enlarged detail the zipper elements 40 and 42 being pressed together so that the guides' main sections 30 are pressing against back side ridges 34 of the zipper elements 40 and 42 to interlock the same.

As the closing device proceeds from the left end of the bag across to the right end of the bag, it merely slips off the bag and is ready for use in sealing another bag, (or the same bag again) on the next occasion by following the same procedure as with the first bag. Where the closing device 10 is placed over the top of the bag rather than feeding an end of the bag into the closing device, caution should be taken that the closing device is placed over the zipper elements close to one end of the bag, or be sure the device is run laterally back and forth over the zipper elements so that the bag is sealingly closed. Thus, a closing device permitting repeated usage and which is simple to understand and use, and is entirely effective in sealing tongue and groove type closing elements, has been achieved.

Figure 9:
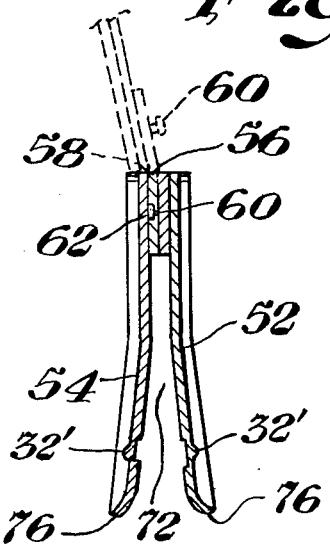
FIG. 9 is a cross-sectional view of the closing device of FIG. 7 taken along the reference line 9—9 thereof.
Figure 7:
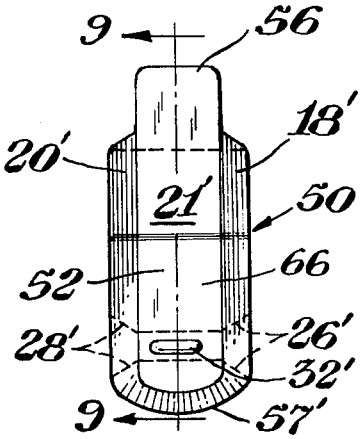
FIG. 7 is a front elevational view of a modified form of a closing device according to the present invention.
Figure 8:
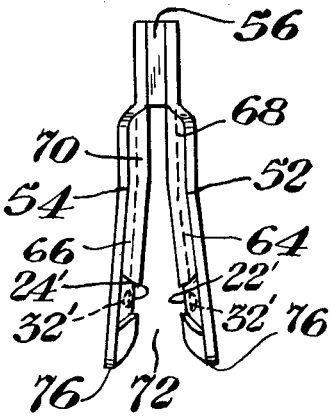
FIG. 8 is a side elevational view of the closing device of FIG. 7, the other side elevational view being the same.

Yet another preferred embodiment of the present invention is illustrated in FIGS. 7 to 10. Here a closing device 50 comprises opposing legs 52 and 54 and a bite portion 56 together presenting an inverted Y-shaped configuration to the device. Closing device 50 can be made of a one-piece construction which is basically flat with a hinge line 58 so that leg 52, as shown in dotted lines in FIG. 9, is directly above leg 54 but can be folded about hinge line 58 to come directly opposite from leg 54 in U-shaped fashion to form the closing device as illustrated by solid lines. To hold the two legs together, the right section can include a barb 60 on one of the legs, such as leg 52, and an aperture 62 to which the barb 60 penetrates in order to fasten the two halves together. With certain thermoplastic materials, hinging is possible because of the resilient nature of the material itself as, for example, with a nylon or polypropylene resin material.

Besides the foldability of the legs 52 and 54 upon one another as above-described, another principle difference between the embodiment shown in FIGS. 7 to 10 and that shown in FIGS. 1 to 4 is that lower portions 64 and 66 of legs 52 and 54 are canted outwardly from upper portions 68 and 70 of the legs 52 and 54 to provide an extra large gap 72 at the ends 74 and 76 of the legs 52 and 54. This gap is generally greater than the combined thickness of the zipper elements 40 and 42 of the bag 38 to be closed so that it is easily placed over the top of the bag for closing in the event this is preferred. The side flanges 18' and 20' are continued around the bottom of each leg as at 57 so that the channel 21' is cup-like. The flange portion 57 will limit the lower extent to which the thumb and finger can easily extend, thereby more accurately locating them over the sensing ridges 32'. The cup-like channel 21' together with the extra large gap 72 combine to permit easy locating of the closing device 50 over the zipper elements. The yoke 56 has also been narrowed somewhat to save material. The other characteristics of the closing device 50 are all fundamentally the same as those of the closing device 10 and are identified by like reference characters with primes supplied. An actual sample of this embodiment was made of materials and had dimensions similar to those of the sample of FIGS. 1 to 4 only the gap 72 between the legs was about ⅛".

While certain representative embodiments and details have been shown for the purpose of illustrating the invention, it will be apparent to those skilled in the art that various changes and applications can be made therein without departing from the spirit and scope of the invention. For example, the closing device can be made and designed of various sizes depending on the particular size of the bag or other container to be closed and particular shape and size of the zipper elements of the bag, and can take different aesthetic appearances and still be comprehended by the basic invention claimed herein.

What is claimed as new is:

1. A closing device usable repeatedly for closing one or more containers having interlocking fastening elements, said device comprising a generally inverted U-shaped element having opposed legs extending from a bite portion, said legs having inside surfaces facing one another, said legs having a first means on their inside surfaces for guidingly engaging and aligning the fastening elements directly opposed to one another, a second means on the outside of said legs located directly opposite said first means, said second means being sensitive to finger touch, a third means on the outside of said legs for guiding the finger into a proper position over said second means, said second and third means permitting ready locating of said first means from the outside of the closing device, said closing device being comprised of semi-rigid material having sufficient flexure to permit said legs to come together to force the fastening elements to engage together.

2. The closing device of claim 1 wherein said legs are resilient enough to be biased outwardly upon release of the pressure closing the legs upon the fastening elements.

3. The closing device of claim 1 wherein said first means contains funnel-like feeding means at the outward edges of the legs for receiving the end of one of the containers and aligning the fastening members directly opposite one another.

4. The closing device of claim 1 wherein said third means comprises edges of the legs flared outwardly to provide a finger receiving channel.

5. The closing device of claim 1 wherein the gap between the legs is sufficient to receive the fastening elements.

6. The closing device of claim 5 wherein the legs are canted outwardly at their lower ends.

7. The closing device of claim 4 wherein the height of the slot between the legs is sufficient to receive the portions of the container located above the fastening elements.

8. The closing device of claim 1 wherein said closing device contains a hinge line intermediate the legs, which hinge line permits the legs thereof to be folded to a position opposed from one another, and a means to secure the legs together in such opposed relationship.

9. A closing device usable repeatedly for closing one or more containers having interlocking fastening elements, said device comprising a generally inverted U-shaped element having opposed facing legs extending from a bite portion, said legs having means for guidingly engaging and aligning the fastening elements directly opposed to one another, said closing device being comprised of semi-rigid material having sufficient flexure to permit said legs to come together to force the fastening elements to engage together, a pressure bump located in said means for increasing closing pressure on said fastening elements.

* * * * *